US008011898B2

(12) United States Patent
Courier

(10) Patent No.: US 8,011,898 B2
(45) Date of Patent: Sep. 6, 2011

(54) HIGH PRESSURE RADIAL PUMP

(75) Inventor: John P. Courier, Renton, WA (US)

(73) Assignee: John P. Courier, Renton, WA (US)

( * ) Notice: Subject to any disclaimer, the term of this patent is extended or adjusted under 35 U.S.C. 154(b) by 1023 days.

(21) Appl. No.: 11/856,600

(22) Filed: Sep. 17, 2007

(65) Prior Publication Data

US 2009/0074591 A1 Mar. 19, 2009

(51) Int. Cl.
*F04B 39/00* (2006.01)
*F04B 53/00* (2006.01)

(52) U.S. Cl. ..... 417/313; 417/273; 219/201

(58) Field of Classification Search ..... 417/273, 417/313; 47/271; 219/201, 536, 542
See application file for complete search history.

(56) References Cited

U.S. PATENT DOCUMENTS

| | | | | |
|---|---|---|---|---|
| 1,964,245 | A | 6/1934 | Benedek | |
| 2,006,880 | A | 7/1935 | Benedek | |
| 2,255,851 | A * | 9/1941 | Lundin | 417/273 |
| 2,255,852 | A | 9/1941 | Lundin | |
| 2,568,357 | A | 9/1951 | Moulden | |
| 3,644,702 | A * | 2/1972 | Kohler | 219/201 |
| 3,927,605 | A | 12/1975 | Siczek | |
| 4,313,714 | A | 2/1982 | Kubeczka | |
| 4,874,297 | A | 10/1989 | Collins | |
| 5,005,765 | A * | 4/1991 | Kistner | 239/135 |
| 5,167,493 | A | 12/1992 | Kobari | |
| 5,388,761 | A * | 2/1995 | Langeman | 239/1 |
| 5,642,988 | A | 7/1997 | Zorn | |
| 6,168,308 | B1 | 1/2001 | Pittman | |
| 6,283,329 | B1 | 9/2001 | Bezaire | |
| 7,740,457 | B2 * | 6/2010 | Lehmann | 417/313 |

FOREIGN PATENT DOCUMENTS

GB 1 382 741 2/1975

OTHER PUBLICATIONS

High Performance Coatings & Foam Equipment: For All Your Spray Foam and Polyurea Applications, Graco, Inc., 2-page brochure, 2006.
Reactor A-20 Plural-Component Proportioner, Graco, Inc., 2-page brochure, Form No. 338319, 2006.
Reactor H-25 and H-XP2 Hydraulic-Driven Proportioners, Graco, Inc., 2-page brochure, 2005.
Reactor H-40 and H-XP3 High-Output Hydraulic Proportioners, Graco, Inc., 2-page brochure, 2007.
Reactor, High-Performance Porportioning System Designed to Apply Polyurea, Foam and Other Fast-Set Materials, Graco, Inc., 12-page catalog, Form No. 300628, 2002-2003.
Reactor & Fusion, High-Performance Proportioning Systems Designed to Apply Polyurea, Foam and Other Fast-Set Materials, Graco, Inc., 20-page catalog, Form No. 300615, 2002-2005.

* cited by examiner

*Primary Examiner* — Devon C Kramer
*Assistant Examiner* — Peter J Bertheaud

(57) ABSTRACT

A pump (100) includes a pump block (102) including a heater (140), a middle block member (120) and an upper block member (122). Cylinder sleeves (130) are disposed between the middle and upper block members, and a piston assembly (160) is disposed in the block with pistons (162) reciprocatingly disposed in the cylinder sleeves. A drive motor (90) drives a twin gear assembly (170) and slave gears (168) to drive the pistons. Headers (104, 105) channel fluid from an external source to the cylinder sleeves, and from the cylinder sleeves to the heater. The heater includes a plurality of heaters such as cartridge heaters (150) that heat the received fluid. In the preferred device, A-side and B-side component are simultaneously pumped. The heater includes A-side and B-side flow paths for heating the components. The pressurized fluid (s) is dispensed through outlets (108, 110).

16 Claims, 10 Drawing Sheets

HIGH PRESSURE RADIAL PUMP

BACKGROUND

High pressure fluid pumps are used in many industrial applications. In particular, many modern coating and insulating applications require consistent high pressure delivery of two components that react quickly with each other. Such applications typically require delivery of the two components, commonly referred to as "A-side" and "B-side," simultaneously to a delivery device such as a sprayer where the components are mixed immediately prior to being discharged. Apparatus for delivering multiple-components to a nozzle apparatus are sometimes referred to as proportioners. Applications that require delivery of multiple components include plural-component polyurethane spray foam, tank and pipe coatings, adhesives and caulk, rim and band joist applications and the like.

Spray polyurethane foam ("SPF") has become popular for its insulation value and air barrier qualities. The plastic material comes in several basic types, including: ½-lb, 2-lb and 3-lb. These types are used in insulation applications as barriers in buildings, for example. These foams can also help control condensation within buildings and have other environmental benefits.

These ½-lb, 2-lb, and 3-lb SPF are made from blended systems of polyol resins, catalysts, surfactants, fire retardants, and blowing agents on the B-side, with polymeric MDI (methylene diphenyl diisocyanate) on the A-side. The difference between SPF types is in how these materials are formulated.

Two-component polyurea spray elastomers are useful for their fast reactivity and relative insensitivity to moisture, making them ideal for coating large surface area projects, such as secondary containment, manhole and tunnel coatings, and tank liners. Excellent adhesion to concrete and steel can be achieved using suitable primer and surface treatment, as is known in the art. New two-component polyurethane and hybrid polyurethane-polyurea elastomer systems have been developed and used for spray-in-place load bed liners and the like. This technique for coating pickup truck beds and other cargo bays creates a durable, abrasion resistant composite with the metal substrate, and eliminates corrosion and brittleness associated with drop-in thermoplastic bed liners.

Polyurea compositions have been used as components of liquid pavement marking compositions, as described in U.S. Pat. No. 6,166,106 to Purgett et al. The binder of the pavement marking compositions described therein is prepared from a two-part system that includes an amine component and an isocyanate component. The composition described therein contains reflective elements to provide visibility and reflectivity to the pavement markings over an extended length of time.

Polyurea spray compositions have also been used for coating or lining materials. For example, U.S. Pat. No. 5,405,218 to Hyde-Smith discloses fast curing materials that can be applied directly to composite and metal surfaces.

With the increasing demand for two component systems such as polyurea, polyurethane, including polyurethane foams and the like, there is a need for improvements in the equipment for delivering the components for such systems.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
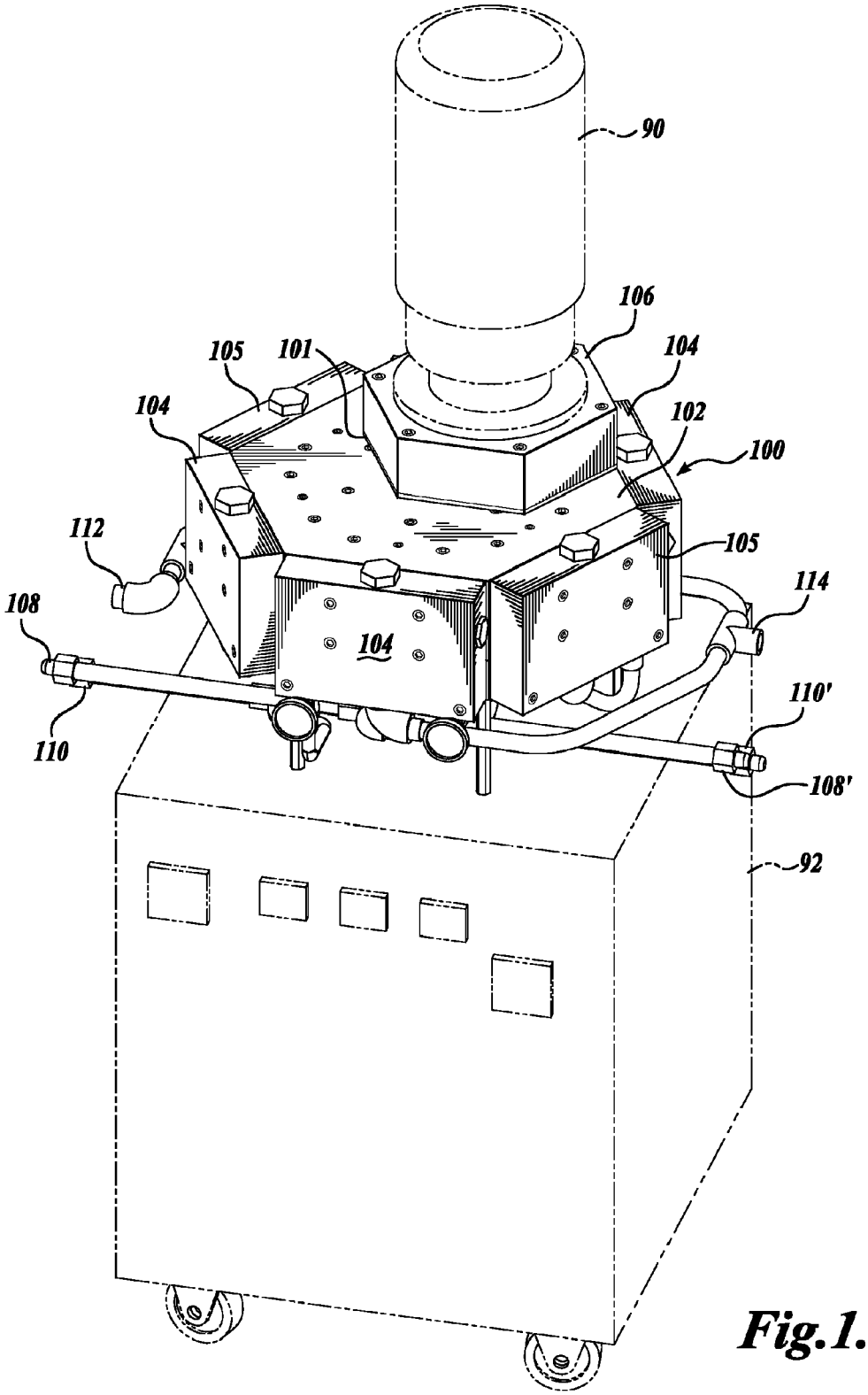
FIG. 1 shows an assembled view of a radial reciprocating two-component pump according to the present invention, including a driver motor, and ready to be connected to source materials and a heated spray gun hose.

A currently preferred embodiment of the present invention will now be disclosed with reference to the figures, wherein like numbers indicate like parts. FIG. 1 shows a perspective view of a high pressure two-component heated pump 100 in accordance with the present invention. In this embodiment, the two-component heated pump 100 simultaneously heats and pumps two components, the components being referred to herein as the A-side component and the B-side component. One or both of the components typically must be heated to a relatively high temperature, and delivered under pressure separately to a conventional spray gun wherein the A-side and B-side components are mixed or brought together just prior to being ejected. Very high pressures are typically required to pump the A-side and B-side components, for example between 2,000 and 3,000 psi, or more.

The two-component heated pump 100 shown in the FIGURES is a radial reciprocating pump. In FIG. 1 the pump 100 is shown with a drive motor 90 (shown in phantom) drivably attached to the pump 100. The pump 100 is mounted on a mobile support structure 92 (shown in phantom) that would typically house auxiliary and/or support equipment such as controls, transformers, relays and the like, for example, a frequency controller for the drive motor 90. The particular drive motor and mounting structure selected is not important to the present invention, and many suitable options for the drive motor and mounting structure are known in the art.

Referring still to FIG. 1, the two-component heated pump 100 includes a central pump block 102 that is generally hexagonal in shape. Six headers 104, 105 are attached to the outward faces of the pump block 102. A motor mount assembly 106 is attached to the top of the block 102 to facilitate attachment of the drive motor 90 to the pump 100. Preferably, a thermally insulating panel, for example a Teflon® panel 101, is provided between the motor mount assembly 106 and the pump block 102 to reduce the heat transfer therebetween. An A-side component inlet 112 is shown on the left side of FIG. 1, and a B-side component inlet 114 is shown in the right side. The inlets 112, 114 are adapted to be connected to sources of A-side component and B-side component, respectively. Typically, the A-side and B-side components are provided to the respective inlets 112, 114 at a relatively low pressure.

The pump 100 includes left and right outlets 110, 110' for the A-side component, and left and right outlets 108, 108' for the B-side component. Alternatively, a single outlet (left or right) for each of the components may be provided. However, providing a pair of outlets for each component provides certain advantages. For example, a user may connect a conventional hose assembly (not shown) to either side of the pump 100, whichever is most convenient for the desired application. Alternatively, hose assemblies may be connected to both the left and right outlets in applications where dual spraying may be suitable.

Figure 2:
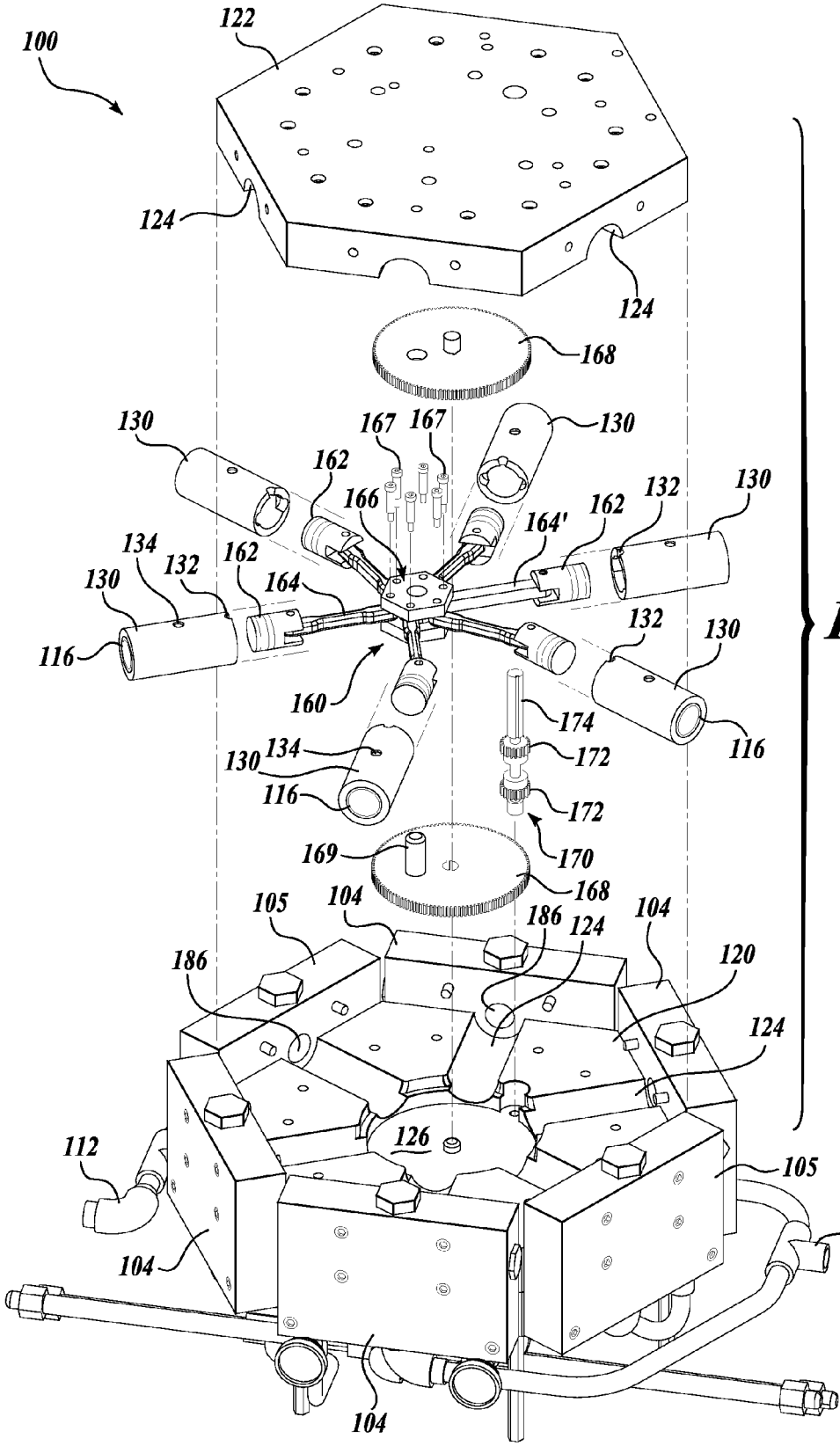
FIG. 2 is a partially exploded view of the two component pump shown in FIG. 1, with the motor and motor mount not shown, for clarity.
Figure 3:
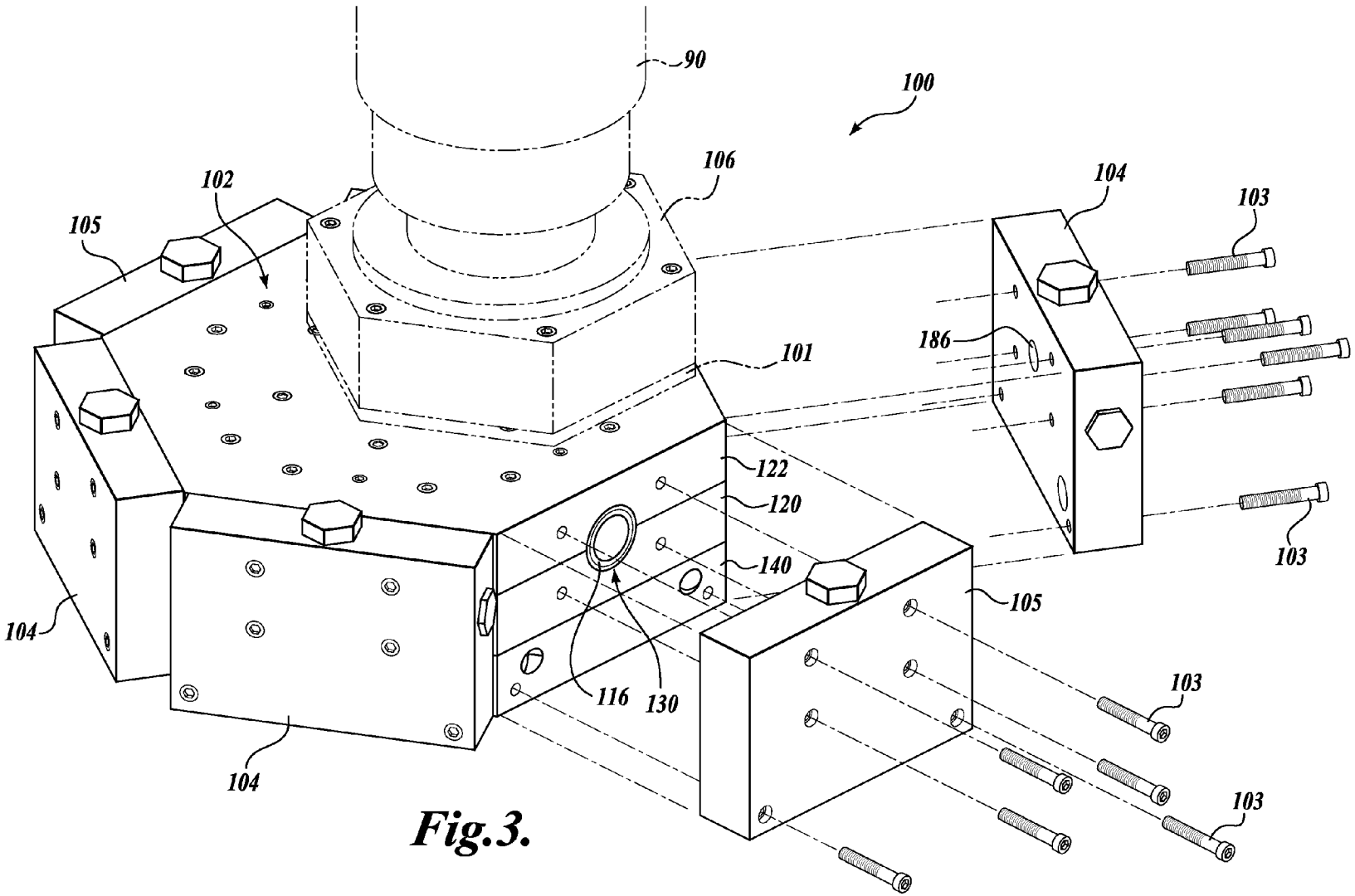
FIG. 3 is another partially exploded view of the two-component pump shown in FIG. 1, with some components removed, for clarity.

Refer now also to FIG. 2 and FIG. 3, each showing partially exploded views of the pump 100. The pump block 102, which is preferably, although not necessarily, aluminum, is constructed in three major parts: a lower member comprising a heater 140; a middle block member 120; and an upper block member 122. The middle block member 120 and the upper block member 122 include semi-cylindrical radial apertures 124 that cooperatively define cylindrical apertures, and a central gear drive recess 126. Cylinder sleeves 130 are disposed in each of the cylindrical apertures 124. The cylinder sleeves 130 are retained in the cylindrical apertures by the clamping force between the middle and upper block members, and with suitable set screws (not shown).

The cylinder sleeves 130 are positioned to abut corresponding headers 104, 105 generally aligned with a port 186 in the header 104, 105 that fluidly connects to the desired component, as discussed below. High-pressure O-ring seals 116 are provided between the cylinder sleeves 130 and the corresponding header 104, 105. In a current embodiment, the cylinder sleeves 130 have a U-shaped recess 132 at one end that is engaged by a set screw (not shown) having a tapered end, such that the set screw urges the cylinder sleeve 130 toward the corresponding header 104, 105. A second recess 134 is also provided in the cylinder sleeves 130, which is engaged by a second set screw (not shown). The headers 104, 105 are attached to the block 102 with bolts 103.

A piston assembly 160 is rotatably mounted in the gear drive recess 126. The piston assembly 160 includes six pistons 162 that are sized and positioned to engage the six corresponding cylinder sleeves 130. The pistons 162 are pivotably connected to distal ends of connecting rods 164 and 164'. The proximal end of five of the connecting rods 164 are pivotably attached to a hub assembly 166 with pivot pins 167. The sixth connecting rod 164' is fixedly connected to the hub assembly 166.

The hub assembly 166 is offset mounted to twin slave gears 168 (for example, wheel gears) through a pivot post 169. A twin drive gear assembly 170 with vertically spaced drive gears 172 is rotatably mounted at the periphery of the gear drive recess 126. The drive gears 172 (for example, spur gears) are positioned to drive the twin slave gears 168. A keyed shaft 174 on the drive gear assembly 170 is adapted to be driven by the drive motor 90 (FIG. 1). Each of the headers 104, 105 include a first header port 186 that is open to the associated cylinder sleeve 130, and that provides a flow path for drawing the desired component into, and out of, the cylinder sleeve 130, as discussed in more detail below.

The heater 140 is attached to the middle block member 120, preferably with a thermal coating material therebetween to improve heat transfer. In general, it is desired to include a thermal coating material between components to improve heat transfer, excepting the interface between the motor mount 106 and the block 102, wherein a heat insulating layer 101 (FIG. 1) is preferably provided therebetween.

Figure 4:
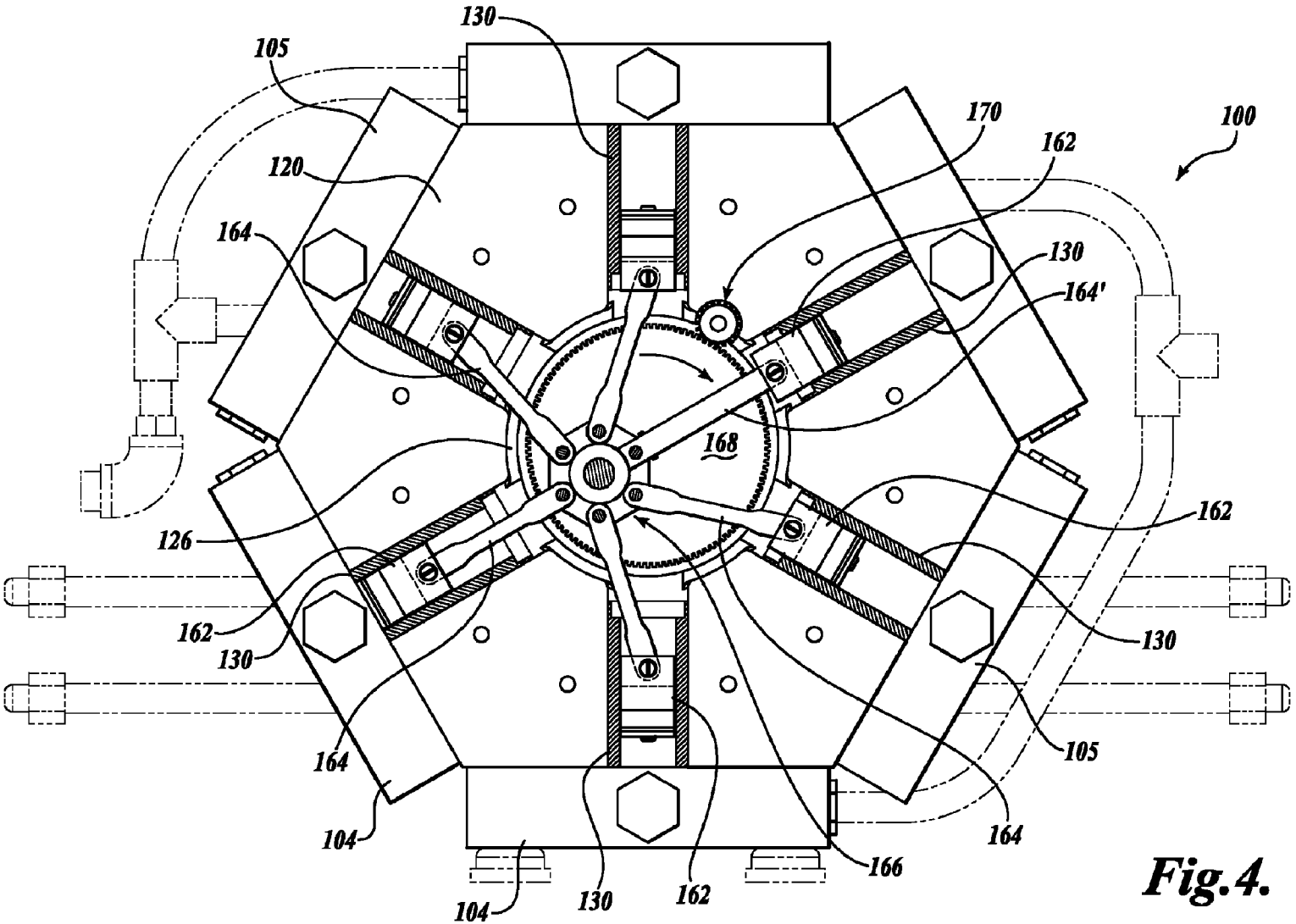
FIG. 4 is a horizontal cross sectional top view of the two-component pump shown in FIG. 1, showing the piston assembly arrangement.

Refer now also to FIG. 4, which shows a partially cross-sectional plan view of the pump 100 showing the pistons 162 at a particular drive assembly position. As the drive motor 90 drives the twin gear drive assembly 170, the slave gears 168 rotate in the gear drive recess 126. The offset mounted hub assembly 166 travels in a circular path, causing the pistons 162 to reciprocate in the cylinder sleeves 130. The pistons 162 approach the top dead center ("TDC") position within the cylinder sleeves 130 sequentially. It will also be appreciated that a benefit of the twin slave gears 168 and twin drive gear assembly 170 (as opposed to an optional single-gear drive assembly) is high reliability due to the substantially symmetric loading on the drive gear assembly.

Figure 5:
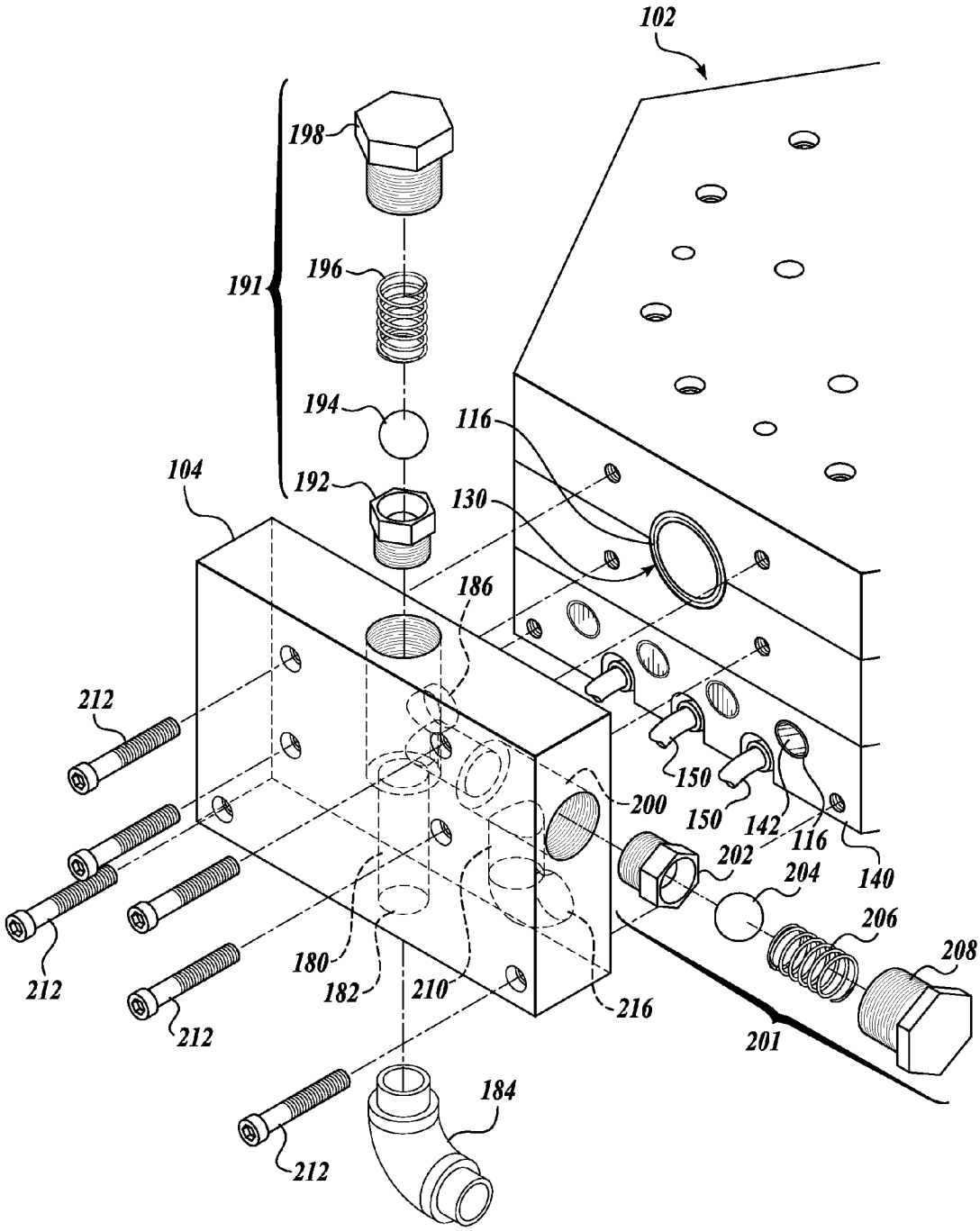
FIG. 5 is a fragmentary, partially exploded view of the two-component pump shown in FIG. 1, and showing the direct header arrangement.

Refer now to FIG. 5, a partially exploded fragmentary view showing various details of one of the direct headers 104 and its attachment to the pump block 102. The header 104 attaches to the pump block 102 with a plurality of bolts 212 (six shown). The header 104 includes a first cylindrical channel 180 having an inlet end 182 that receives a fitting 184. The fitting 184 is fluidly connected to the source of one of the A-side and B-side components. The first header port 186 extends from an inner face of the header 104 to the channel 180. The port 186 is positioned to fluidly engage the cylinder sleeves 130 disposed in the pump block 102 such that as the associated piston 162 (not shown) moves away from TDC, A-side or B-side component is drawn through the fitting 184 and into the cylinder sleeve 130. A first check valve assembly 191 is disposed in the channel 180. The check valve assembly 191 includes a valve seat 192 that is threadably installed in the channel 180 below the port 186, a ball valve 194 that seats in the valve seat 192, a spring 196 that urges the ball valve 194 toward the seat 192, and a threaded plug 198. For clarity, the sealing elements, e.g., o-rings for the threaded components, are not shown. Although this check valve assembly 191 is currently preferred, other types of check valves are known in the art and may be used without departing from the present invention.

The header 104 includes a second cylindrical channel 200 that intersects the first cylindrical channel 180. A second check valve assembly 201 is disposed in the second cylindrical channel 200, the second check valve assembly including a valve seat 202, ball valve 204, spring 206, and threaded plug 208.

A third channel 210 intersects the second channel 200, and a header outlet port 216 extends from the inner face of the header 104 to the third channel 210. The outlet port 216 is positioned to fluidly engage a heater inlet flow port 142.

Figure 6A:
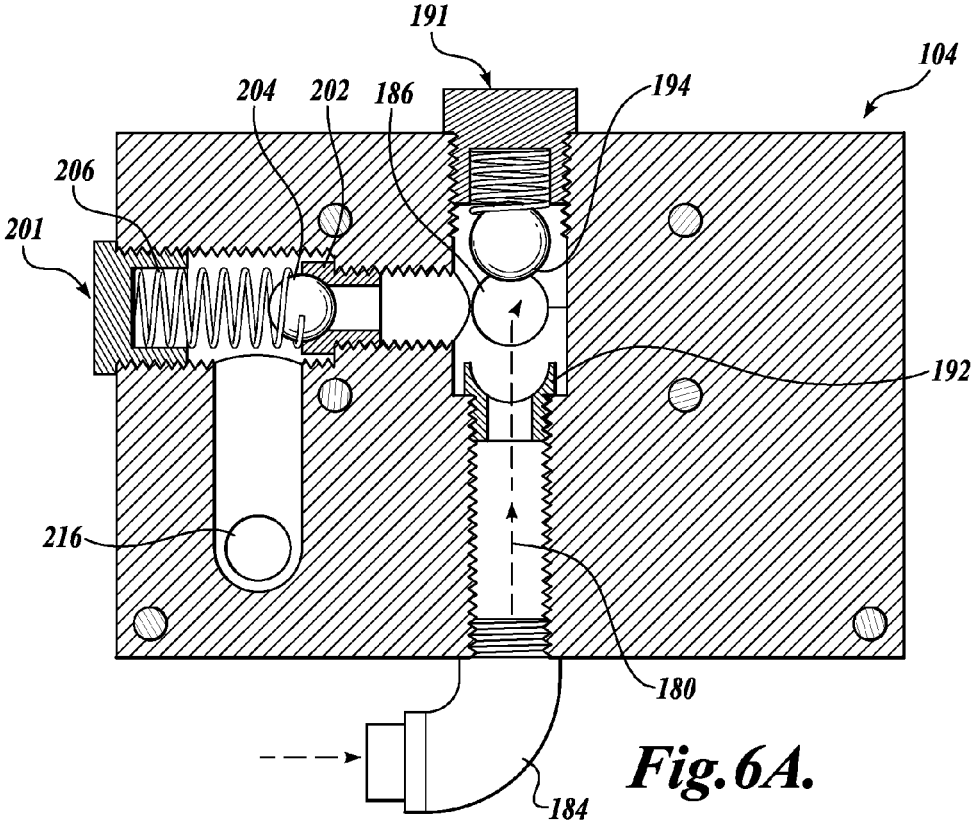
FIGS. 6A and 6B are cross-sectional views of the direct header for the two-component pump shown in FIG. 1, FIG. 6A showing the valve positions during the intake stroke, and FIG. 6B showing the valve positions during the output stroke.
Figure 6B:
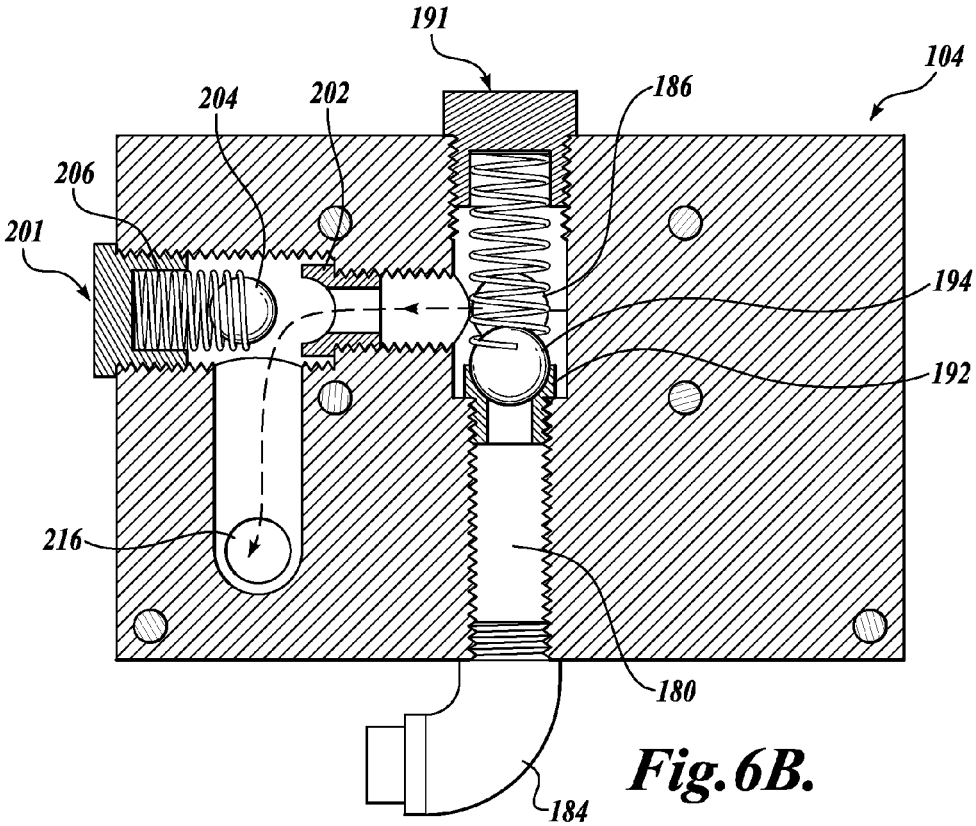

The function of the direct header 140 will now be appreciated, referring also to FIGS. 6A and 6B, which show a cross-section of the header 104. FIG. 6A shows the position of the valve assemblies 191 and 201 during the intake stroke, and FIG. 6B shows the position during the output stroke. During the intake stroke, the piston (not shown) moves inwardly, away from the header 104 such that component (A-side or B-side) is drawn into the first channel 180 through fitting 184. Fluid pressure urges the ball valve 194 of the first valve assembly 191 away from the seat 192, opening the flow path such that the component flows into the cylinder sleeve 130 through the first port 186.

During the output stroke (FIG. 6B) the piston 162 moves towards TDC, and the component that was drawn into the cylinder sleeve 130 is pushed back through the port 186. The spring 196 pushes the ball valve 194 towards its associated valve seat 192 just before the output stroke, closing the first channel 180. The fluid pressure from the output stroke pushes the second ball valve 204 in the second valve assembly 201 away from seat 202, opening the flow path to the outlet port 216 such that the component flows into the heater inlet port 142. After the output stroke, the spring 206 returns the ball valve 204 to the seat 202.

Figure 7:
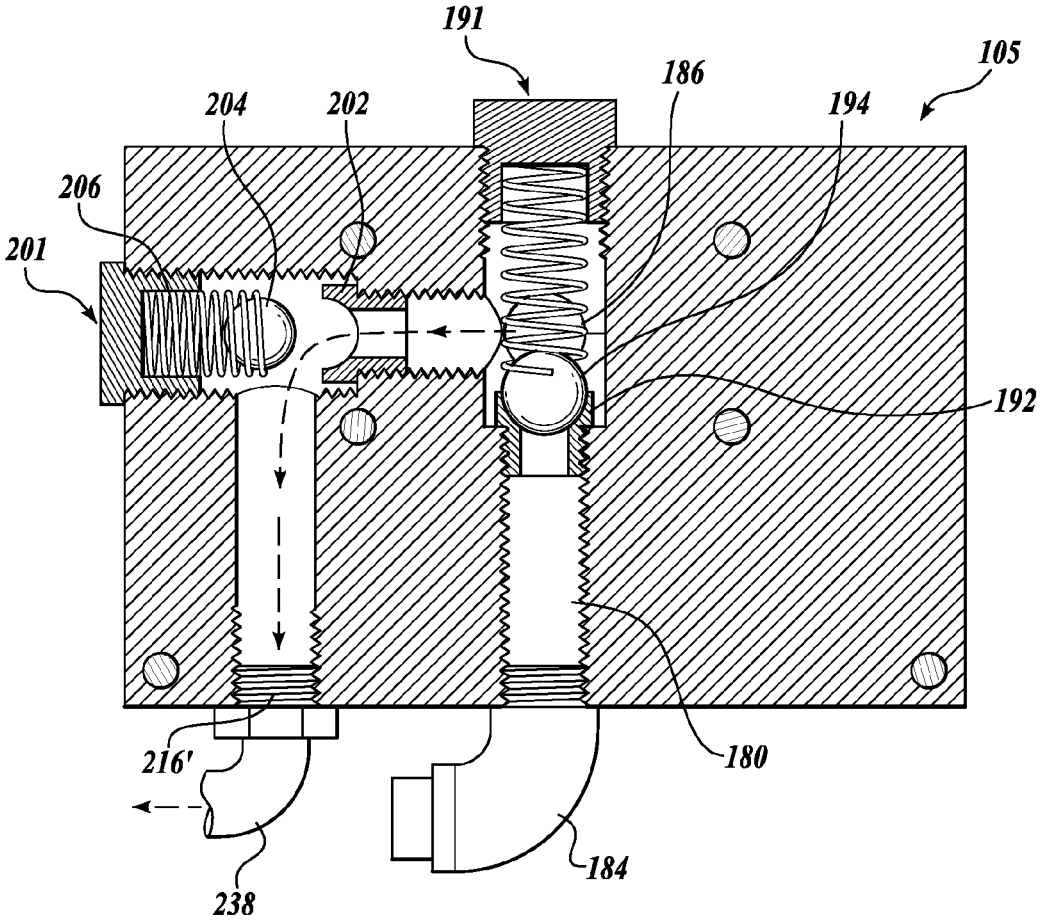
FIG. 7 is a cross-sectional view of the bypass header for the two-component pump shown in FIG. 1.

FIG. 7 shows a cross-sectional view of the bypass header 105, which is similar to the direct header 104, and includes similar first and second check valve assemblies 191 and 201. In the bypass header, however, during the outflow stroke the component is delivered to a bypass header outlet port 216'. The component pumped through the bypass headers 105 is not delivered directly to the heater 140, but is delivered through a bypass tubing 238 (or 239) to the heater 140, as shown in FIG. 8.

Figure 8:
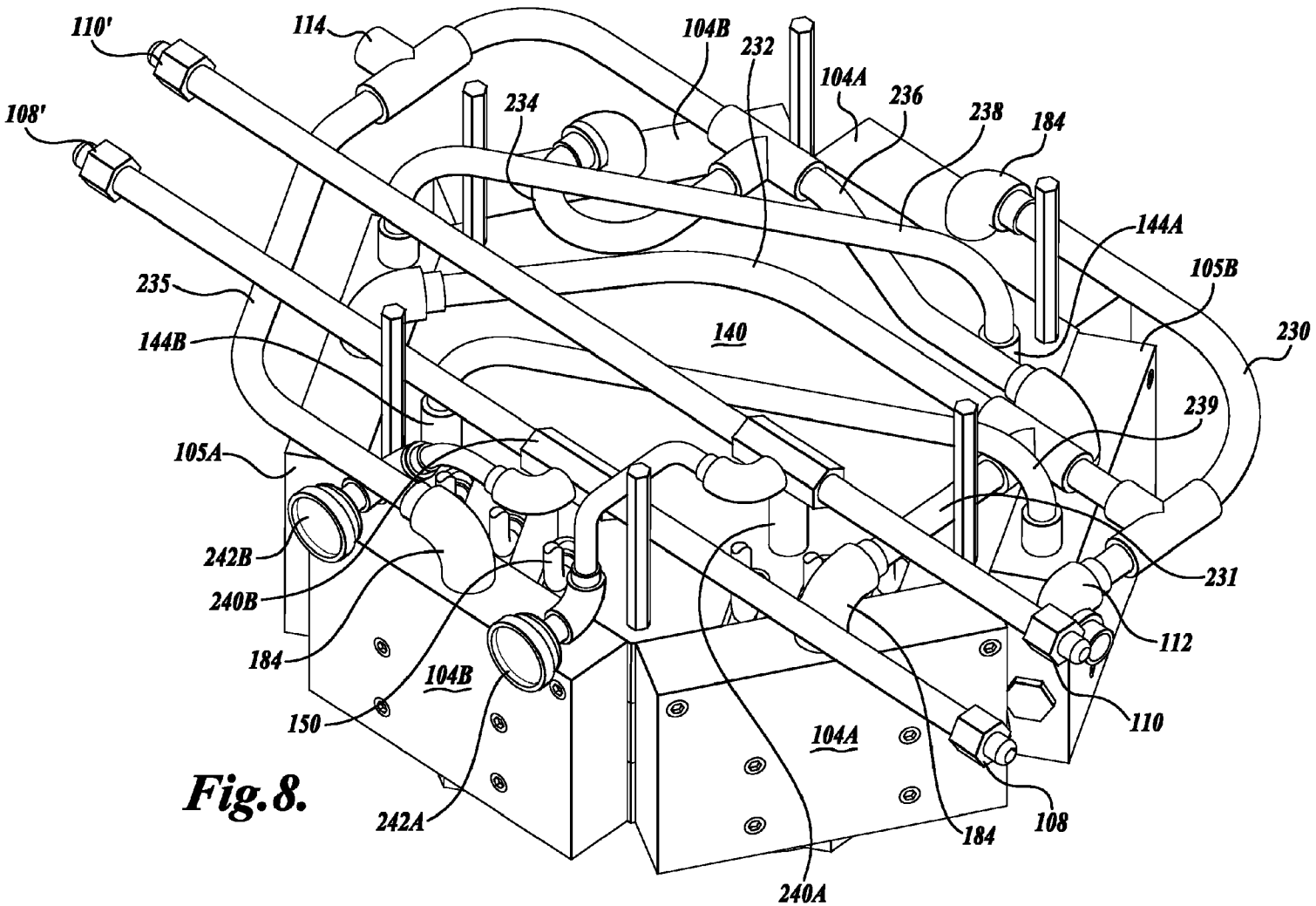
FIG. 8 is a bottom view of the two-component pump shown in FIG. 1.

Refer now to FIG. 8, which shows a bottom view of the two-component heated pump 100. For convenience, the A-side component headers are identified with the letter "A," and the B-side component headers are identified with the letter "B." The A-side component inlet 112 is fluidly connected through tubing 230, 231 to two direct headers 104A, and to the bypass header 105A through tubing 232. It can be seen from FIG. 8 that the A-side component is delivered to alternate headers.

Similarly, the B-side component inlet 114 is fluidly connected through tubing 234, 235 to direct headers 104B and to the bypass header 105B through tubing 236. A first bypass tubing 238 fluidly connects the outlet port of the A-side bypass header 105A to a first inlet bypass port 144A in the heater 140. Similarly, a second bypass tubing 239 fluidly connects the outlet port of the B-side bypass header 105B to a second inlet bypass port 144B in the heater 140. The reason for the bypass tubing 238, 239 will become clear with reference to FIG. 9.

The A-side component exits the heater 140 through A-side component outlet fitting 240A, which is fluidly connected to the A-side outlets 110, 110'. The B-side component exits the heater 140 through B-side component outlet fitting 240B, which is fluidly connected to the B-side outlets 108, 108'. The fittings 240A and 240B may also be connected to associated pressure gauges 242A and 242B, respectively.

Figure 9:
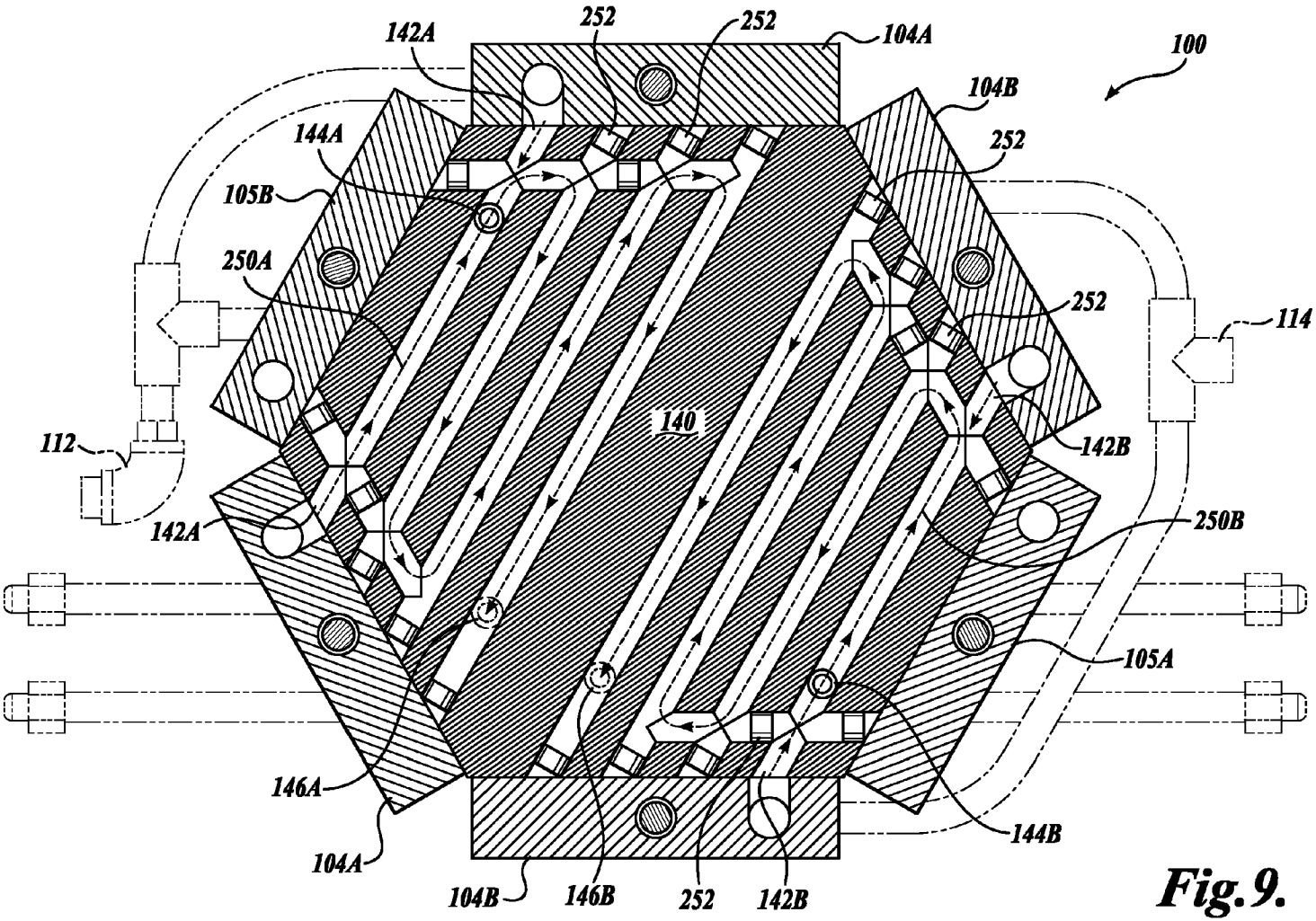
FIG. 9 is a horizontal cross sectional top view of the two-component pump shown in FIG. 1 through the heater and showing the flow paths through the heater.
Figure 10:
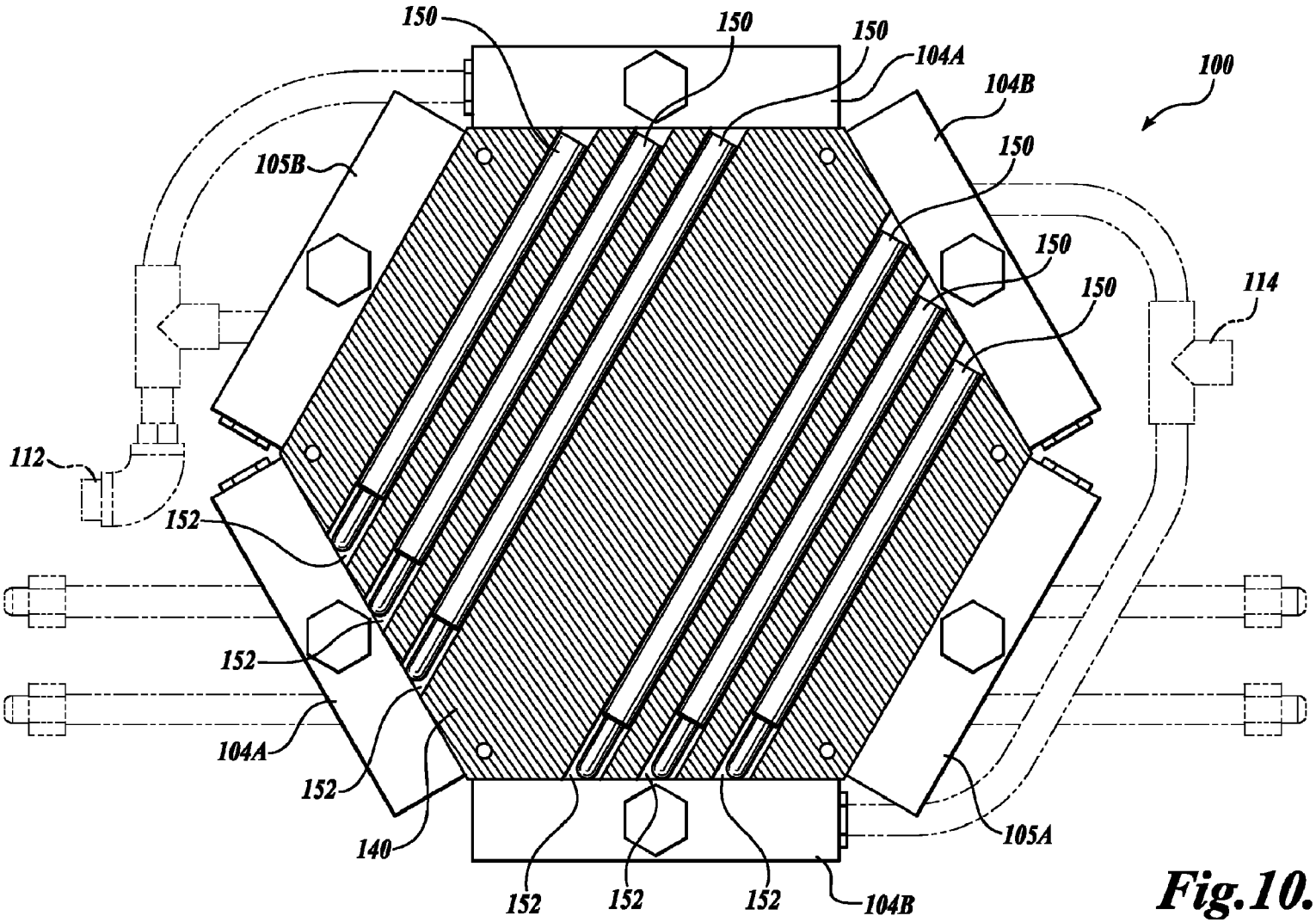
FIG. 10 is a horizontal cross sectional top view of the two-component pump shown in FIG. 1 through the heater and showing the heating units.

FIG. 9 shows a partially cross-sectional top view of the pump 100, showing the A-side component flow path 250A and the B-side component flow path 150B through the heater 140. As indicated by dashed arrow, the A-side flow path 250A is serpentine and receives A-side component from the two direct headers 104A, and from the bypass header 105A through the bypass port 144A. For convenience in manufacturing, the serpentine path is formed by machining straight-line intersecting flow paths and installing a number of plugs 252 to direct the flow in the desired path. Other methods of manufacture may alternatively be used without departing from the present invention.

A serpentine B-side flow path 250B is similarly provided, receiving B-side component from the two headers 104B through inlet ports 142B, and from the bypass header 105B through the bypass inlet port 144B. The A-side component exits the heater 140 through outlet port 146A to fitting 240A (FIG. 8), and the B-side component exits the heater 140 through outlet port 146B to fitting 240B.

Six heating units 150 are installed in the heater 140. In a currently preferred embodiment, the heating units 150 are 2,325 W cartridge heaters with internal thermocouples, although other heating units or different wattages may alternatively be used. The heating units 150 are slidably inserted into transverse channels 152 in the heater 140, preferably with a thermal coating to improve heat transfer to the body of the heater 140. The heating units 150 are disposed generally below the flow paths 250A, 250B. The heating units 150 are preferably separately controllable, such that the operation of the heating units 150 can be optimized. For example, thermocouples may be used to monitor the temperature of the A-side and B-side components, and the resulting signals used to control the operation of the heating elements to maintain a desired temperature. The lead wires (not shown) for the heating units 150 extend from the bottom of the heater 140 and are connected to a conventional control unit and suitable power source. It is also contemplated that one or more thermocouples, pressure sensors, and the like may be used to monitor and shut down the operation of the pump 100 and/or the heating elements 150 if preset limits are exceeded. Alternatively, with straightforward changes that will be apparent to persons of skill in the art, heating units may alternatively be placed directly in the fluid flow paths 250A and 250B.

The operation of the pump 100 can now be appreciated, with particular reference to FIGS. 1, 4, 9 and 10. The A-side component is provided at a relatively low pressure to the A-side inlet 112, and the B-side component is similarly provided to the B-side inlet 114. As the drive motor 90 drives the pump 100, A-side component is sequentially drawn into alternate cylinder sleeves 130 through headers 104A and 105A, and B-side component is sequentially drawn into alternate cylinder sleeves 130 through headers 104B and 105B. The component is then pumped from the cylinder sleeves 130 to the A-side component flow path 250A in the heater 140, or the B-side component flow path 250B in the heater.

A novel aspect of the present pump 100 is that the three pistons for each component sequentially pump material into the heater 140. This results in a very smooth pressure profile in the pumped fluid component, due to the overlapping output strokes by the pistons 162.

The A-side and B-side components are heated by the heating units 150 in the heater 140. The heating units 150 are preferably independently controllable, such that the temperature of the A-side and B-side components can be precisely controlled. Another novel aspect of the present pump 100 is the close thermal connection between the various components, which provides a very stable thermal mass. Although the heating units 150 are disposed in the heater 140, it will be appreciated by persons of skill in the art that virtually the entire pump 100 will heat up. Therefore, the A-side and B-side components will begin heating as they enter the headers 104, 105, and during the pumping process, before entering the heater 140. Moreover, by enclosing the compact pump 100 in a thermal barrier such as a blanket (not shown), the loss of heat can be minimized, providing an extremely efficient system.

The heated A-side and B-side components are then expelled under high pressure to the left and right outlets 108, 108', 110, 110'.

The currently preferred embodiment has been described and shown in the figures to aid persons of skill in the art in understanding novel aspects and principles of the present invention. The invention may be practiced with modifications that will be readily apparent and obvious to artisans. For example, it is contemplated that pump 100 may alternatively be constructed as two independent pumping units, one for each component. A straightforward way to accomplish this would be to provide two pump blocks, each with three piston and cylinder assemblies (for example), and stacking or otherwise physically associating the two pumps such that the output from the two pump blocks may be delivered simultaneously to a single gun. An advantage of the two-pump configuration would be that it would make it easy to adjust the relative quantities of the two components that are pumped.

It is also contemplated that different means for heating the components may be provided. For example, one or more separable plate-type heating units may be provided underneath the heater. These and other variations on the present invention will become apparent to persons of skill in the art based on the disclosure herein.

While illustrative embodiments have been illustrated and described, it will be appreciated that various changes can be made therein without departing from the spirit and scope of the invention.

The invention claimed is:

1. A radial pump comprising: a pump block defining a plurality of radially disposed cylinders;

a plurality of pistons, each piston associated with one of the plurality of radially disposed cylinders;

a plurality of connecting rods, each connecting rod having a first end and a second end, the first end being pivotably connected to one of the plurality of pistons;

a drive assembly rotatably disposed in the block, the drive assembly comprising a central slave gear and a hub assembly pivotably attached to the slave gear such that the hub assembly moves along a circular path as the slave gear rotates, and wherein the connecting rods are attached to the hub assembly such that rotation of the slave gear causes the plurality of pistons to reciprocate within the associated cylinder;

a plurality of headers attached to the pump block, each header associated with one of the plurality of radially disposed cylinders, each header adapted to receive a fluid component and channel the received fluid component to the associated cylinder, further comprising an A-side component inlet that is adapted to be fluidly connected to a source of A-side fluid component, and a B-side component inlet that is adapted to be fluidly connected to a source of B-side fluid component, and further wherein half of the plurality of headers are fluidly connected to the A-side component inlet, and the other half of the plurality of headers are fluidly connected to the B-side component inlet; and a heater attached to the pump block, the heater comprising an A-side component flow path and a B-side component flow path, and further comprising a first plurality of heating elements associated with said A-side component flow path, and a second plurality of heating elements associated with said B-side component flow path.

2. The radial pump of claim 1, wherein the plurality of pistons comprise six pistons.

3. The radial pump of claim 1, wherein the pump block comprises a middle block member and an upper block member that is releasably attached to the middle block member, and further wherein the plurality of radially disposed cylinders comprise separable cylinder sleeves that are retained between the middle and upper block members.

4. The radial pump of claim 1, wherein headers fluidly connected to the A-side component inlet are disposed between headers fluidly connected to the B-side component inlet.

5. The radial pump of claim 1, wherein the headers include valves that are operable to open a flow path between the associated cylinder and the source of one of the A-side fluid component and the B-side fluid component during an intake stroke in the associated cylinder, and to open a flow path between the associated cylinder and the heater during an output stroke in the associated cylinder.

6. The radial pump of claim 1, wherein the first and second plurality of heating elements comprise a plurality of cartridge heaters.

7. The radial pump of claim 6, wherein the plurality of cartridge heaters are independently controllable.

8. The radial pump of claim 1, wherein the headers comprise at least one direct header that is adapted to direct a flow directly to one of the A-side component flow path and the B-side component flow path, and at least one bypass header that is adapted to direct a flow through a bypass tubing to one of the A-side component flow path and the B-side component flow path.

9. The radial pump of claim 1, further comprising a drive motor that drivably engages the drive assembly through a twin gear drive assembly.

10. The radial pump of claim 9, wherein the drive motor is attached to the pump block with a motor mount, and further comprising an insulating panel between the motor mount and the pump block.

11. The radial pump of claim 1, further comprising a first outlet from the A-side component flow path, and a second outlet from the B-side component flow path.

12. A two-component radial pump for pumping and heating an A-side component and a B-side component, the pump comprising:

a pump block comprising a lower block member defining a heater, a middle block member and an upper block member, the pump block defining a plurality of outwardly disposed faces;

a plurality of cylinder sleeves retained by the middle block member and the upper block member, the cylinder sleeves defining an opening at one of the plurality of outwardly disposed faces;

a piston assembly rotatably disposed in the pump block, the piston assembly comprising a plurality of pistons, wherein each piston is adapted to reciprocate within one of the plurality of cylinder sleeves;

a means for rotatably driving the piston assembly;

a plurality of headers, each header attachable to one of the plurality of outwardly disposed faces defined by the pump block, each header comprising an inlet port and an outlet port, and wherein each header defines an inlet flow path between the inlet port and the opening defined by one of the cylinder sleeves, and an outlet flow path between the cylinder sleeve and the heater;

wherein some of the plurality of headers are adapted to receive an A-side component from an external source and to direct the received A-side component to the heater; and the rest of the plurality of headers are adapted to receive B-side component from an external source and to direct the received B-side component to the heater.

13. The two-component pump of claim 12, wherein the heater comprises a first flow path adapted to receive the A-side component, and a second flow path adapted to receive the B-side component.

14. The two-component pump of claim 13, wherein the heater further comprises a plurality of heating units that are positioned near the first and second flow paths.

15. The two-component pump of claim 14, wherein the heating units comprise cartridge heaters that are slidably inserted into the heater generally below the first and second flow paths.

16. The two-component pump of claim 12, wherein the piston assembly comprises six pistons.

* * * * *